US009097460B2

(12) United States Patent
Jørgensen

(10) Patent No.: US 9,097,460 B2
(45) Date of Patent: Aug. 4, 2015

(54) CONTAINER DRYING DEVICE

(71) Applicant: SEMI-STAAL A/S, Helsingoer (DE)

(72) Inventor: John Jørgensen, Gilleleje (DK)

(73) Assignee: SEMI-STAAL A/S, Helsingoer (DK)

( * ) Notice: Subject to any disclaimer, the term of this patent is extended or adjusted under 35 U.S.C. 154(b) by 0 days.

(21) Appl. No.: 14/248,515

(22) Filed: Apr. 9, 2014

(65) Prior Publication Data

US 2014/0317947 A1 Oct. 30, 2014

(30) Foreign Application Priority Data

Apr. 30, 2013 (DK) ..... 2013 70239

(51) Int. Cl.

| | |
|---|---|
| ***F26B 25/00*** | (2006.01) |
| ***F26B 11/00*** | (2006.01) |
| ***F26B 5/08*** | (2006.01) |
| ***F26B 25/12*** | (2006.01) |

(52) U.S. Cl.

CPC . *F26B 11/00* (2013.01); *F26B 5/08* (2013.01); *F26B 25/003* (2013.01); *F26B 25/12* (2013.01)

(58) Field of Classification Search

CPC ..... F26B 5/08; F26B 11/18; F26B 21/02; F26B 5/00; F26B 11/00; F26B 25/12; F26B 25/003; B08B 3/02

USPC ..... 34/105, 58, 312, 318, 236, 69, 237, 60, 34/381, 313, 328, 104

See application file for complete search history.

(56) References Cited

U.S. PATENT DOCUMENTS

| | | | | |
|---|---|---|---|---|
| 4,987,687 | A | 1/1991 | Sugimoto | |
| 6,341,431 | B1 * | 1/2002 | Noda | 34/58 |
| RE37,627 | E | 4/2002 | Hirano | |
| 6,446,352 | B2 | 9/2002 | Middelkoop et al. | |
| 2004/0222361 | A1 | 11/2004 | Chu et al. | |
| 2008/0295353 | A1 | 12/2008 | Ogawa | |

FOREIGN PATENT DOCUMENTS

| | | | |
|---|---|---|---|
| EP | 0898501 | A1 | 3/1999 |
| EP | 1134527 | A2 | 9/2001 |

(Continued)

OTHER PUBLICATIONS

Danish Office Action for PA2013 70239 dated Dec. 13, 2013.

(Continued)

*Primary Examiner* — Kenneth Rinehart
*Assistant Examiner* — Bao D Nguyen
(74) *Attorney, Agent, or Firm* — Harness, Dickey & Pierce, P.L.C.

(57) ABSTRACT

Container drying device of the spin-dryer type includes at least two booths, each being adapted to accommodate at least one stack of containers, the at least one stack of containers being loaded into the at least two booths in a loading direction, an axis of rotation about which the container drying device being rotatable, extending in a direction substantially perpendicular to the loading direction, and being arranged centrally in the container drying device; and a closing device being movable between a closed position in which the closing device closes the at least two booths at least partially and an open position in which the at least one stack of containers may be loaded into and/or removed from each of the at least two booths, the at least two booths being arranged excentrically, symmetrically on opposite sides of the axis of rotation and substantially in parallel with each other.

12 Claims, 10 Drawing Sheets

(56) References Cited

FOREIGN PATENT DOCUMENTS

Figure 1:
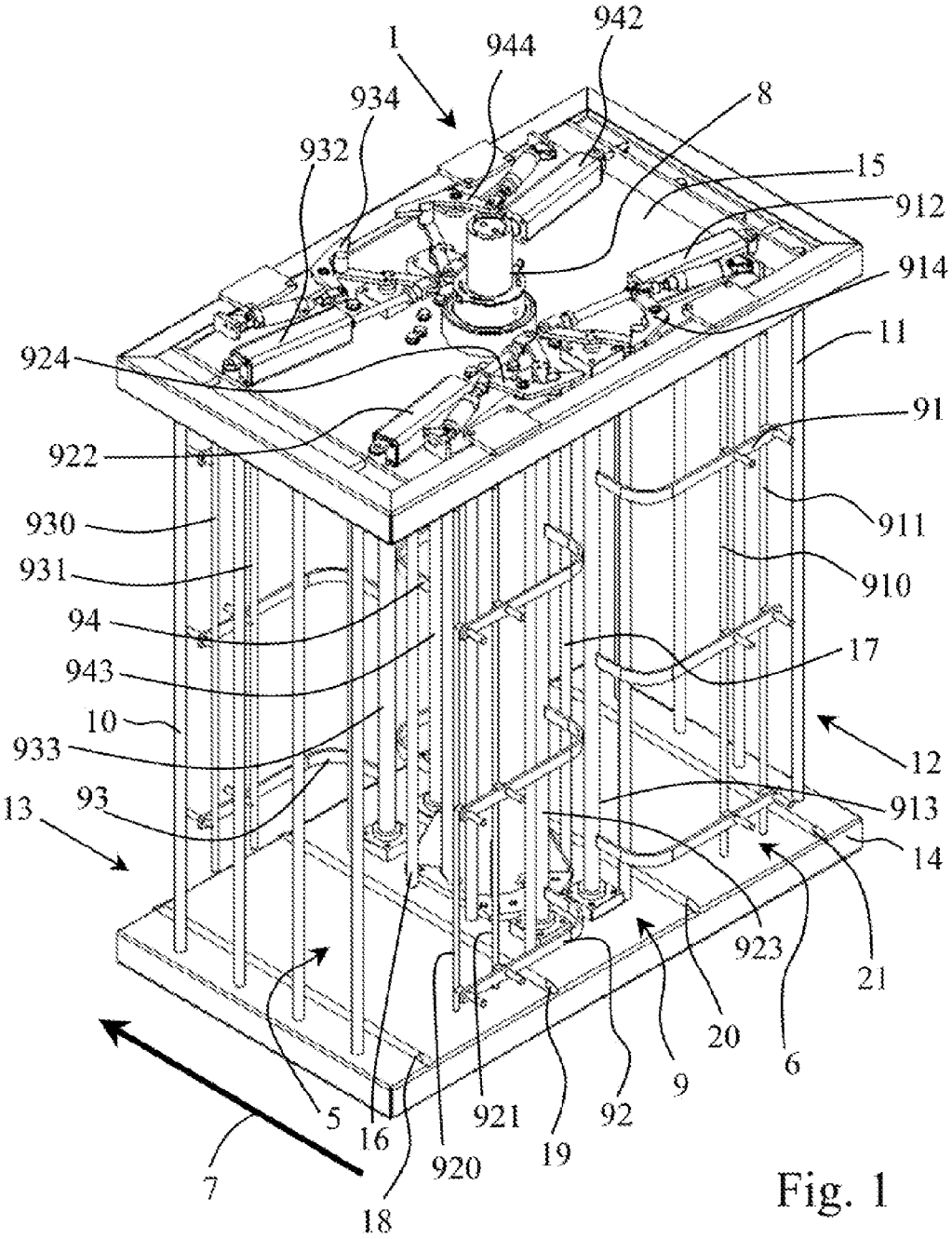

| | | | | |
|---|---|---|---|---|
| EP | 1154214 | A1 | | 11/2001 |
| EP | 1191292 | A1 | | 3/2002 |
| EP | 1191292 | A1 | * | 3/2002 |
| EP | 2136171 | A2 | | 12/2009 |
| JP | 2002-031476 | A | | 1/2002 |
| JP | 2004-101075 | A | | 4/2004 |
| JP | 2004101075 | A | * | 4/2004 |
| JP | 2011-011141 | A | | 1/2011 |
| WO | WO-03/105208 | A1 | | 12/2003 |

OTHER PUBLICATIONS

Danish Search Report for PA2013 70239 dated Dec. 13, 2013.

* cited by examiner

CONTAINER DRYING DEVICE

PRIORITY STATEMENT

The present application hereby claims priority under 35 U.S.C. §119 to Danish patent application number PA 2013 70239 filed 30 Apr. 2013, the entire contents of which are hereby incorporated herein by reference.

INTRODUCTION

The present application relates to a container drying device of the spin-dryer type for drying stacks of containers, particularly containers for distributing foodstuffs and/or containers for distributing medical or pharmaceutical products.

BACKGROUND ART

As used herein the term "container" is intended to cover containers for distributing foodstuffs, such as boxes, crates or cases for containing e.g. bread, fruit, milk in cartons, meat or the like, and/or containers for distributing medical or pharmaceutical products e.g. from a manufacturer to the retail stage of a distribution chain, the containers being re-useable. Preferably, but not exclusively, such containers are of the type comprising openings, such as a grating-like structure, in one or more sidewalls and/or in a bottom. Furthermore, such containers may be of the collapsible type, e.g. of the type having collapsible side walls.

After each use the containers are eventually returned to the manufacturer. Before being used again, the containers must due to hygienic requirements be cleaned, and are therefore typically washed and thereupon dryed by means of a container drying device, particularly a container drying device according to the invention.

Most known container drying machines are capable of processing only one or very few containers at the time or at most one stack of containers at the time, and thus have very low capacities, which results in a time consuming, energy consuming and expensive cleaning procedure.

Another type of container drying machine is known from JP 2004-101075 A, which describes an apparatus for centrifugal drying of stacks of containers in which the stacks of containers are loaded one at the time through a first side of the apparatus and are unloaded one at the time through a second side of the apparatus extending perpendicularly to the first side of the apparatus. The apparatus comprises four positioning maintaining structures arranged eccentrically with respect to the axis of rotation of the apparatus and radially equidistant with respect to each other. When placed in the apparatus, the stacks of containers are initially arranged pairwise either end to end or corner to corner in extension of each other on opposite sides of the center of rotation. As described in JP 2004-101075 A, the position maintaining structures provide for such an arrangement of the containers during rotation of the apparatus that the largest centrifugal forces are acting on the corners of the apparatus.

Furthermore, EP 2 136 171 A2 describes a centrifugal machine for drying stacks of containers, the machine comprising a plurality of compartments arranged eccentrically with respect to the center of rotation of the machine and disposed radially with respect to the center of rotation and angularly equidistant with respect to each other. The stacks of containers are loaded and unloaded one at the time into and out of, respectively, the machine through a designated opening in a central part of a top side of the machine. When placed in the machine, the stacks of containers are arranged pairwise end to end in extension of each other on opposite sides of the center of rotation.

These types of container drying machines may dry several stacks of containers simultaneously, but nevertheless have several drawbacks. Firstly, only one stack of containers may be loaded into or unloaded from the machine at the time. Thereby, the capacity of the machine, i.e. the number of containers treated per time unit, has a relatively low upper limit, and the cleaning procedure becomes correspondingly more time consuming. Secondly, both the construction of the machines itself, being rather complex and thus correspondingly heavy, and the arrangement of the stacks of containers in the machines result in a high energy consumption and a high exposure of less durable parts of the machine to stress caused by the centrifugal forces acting during rotation of the machine.

Therefore, it is the object of the invention to provide a container drying device which has an improved capacity whilst simultaneously being energy efficient and durable in use.

SUMMARY OF THE INVENTION

According to the invention, this is obtained by a container drying device of the spin-dryer type for drying stacks of containers, particularly containers for distributing foodstuffs, comprising at least two booths, each booth being adapted to accommodate at least one stack of containers in a use position of the container drying device, the at least one stack of containers being loaded into the at least two booths in a loading direction, an axis of rotation about which the container drying device is rotatable, the axis of rotation extending in a direction substantially perpendicular to the loading direction, and the axis of rotation being arranged centrally in the container drying device, and a closing device being movable between a closed position in which the closing device closes the at least two booths at least partially such as to retain the at least one stack of containers within each of the at least two booths during rotation of the container drying device and an open position in which the at least one stack of containers may be loaded into and/or removed from each of the at least two booths, wherein the at least two booths are arranged eccentrically, symmetrically on opposite sides of the axis of rotation and substantially in parallel with each other in the container drying device.

By providing the booths arranged substantially in parallel with each other in the container drying device it becomes possible to load and unload stacks of crates into and from the at least two booths simultaneously, which in turn increases the capacity of the device considerably.

By simultaneously providing the booths arranged excentrically in the container drying device and symmetrically on opposite sides of the axis of rotation in the container drying device, at least the largest centrifugal forces acting on the device during rotation are directed in a direction substantially perpendicular to the loading direction, which in turn provides for directing the largest centrifugal forces towards the more sturdy parts of the device.

Thereby a container drying device is provided which has a high capacity and which is simultaneously energy efficient and durable in use.

According to an embodiment the container drying device further comprises at least two opposite outer side elements, the at least two outer side elements being arranged such as to define a fixed outer side of each of the at least two booths opposite the axis of rotation, the at least two booths being arranged excentrically, symmetrically on opposite sides of the axis of rotation and substantially in parallel with each other in the container drying device such that during rotation of the container drying device the centrifugal forces acting on the at least one stack of containers arranged in the at least two booths are directed substantially towards the at least two outer side elements.

By providing such fixed side elements and by directing the centrifugal forces, or at least the largest centrifugal forces, towards the side elements a container drying device of a very simple structure is provided with which at least the largest centrifugal forces may be directed towards the side elements as being particularly sturdy parts of the device. Simultaneously, the use of such side elements for absorbing at least the largest centrifugal forces provides for the possibility of providing a container drying device which is particularly robust whilst still keeping the weight of the device down, which in turn saves energy during rotation.

According to an embodiment the container drying device further comprises two opposite sides extending substantially perpendicular to the loading direction, one of the two opposite sides being an entry side through which the at least two stacks of containers may be loaded into the container drying device simultaneously, and the other of the two opposite sides being an exit side through which the at least two stack of containers may be removed from the container drying device simultaneously.

By providing the entry side and the exit side arranged opposite to each other in the container drying device it becomes possible to load and unload stacks of crates into and from the at least two booths simultaneously in a particularly simple and effective way, which in turn increases the capacity of the device even more by lowering the amount of time needed to unload a set of dry stacks of containers and load a new set of wet stacks of containers to be dried.

According to an embodiment the container drying device further comprises a bottom element defining a bottom of the at least two booths, the axis of rotation being rotatably attached to the bottom element.

Providing a bottom element provides for a container drying device in which the stacks of containers may be arranged and held in a particularly simple and safe manner during rotation as they are supported from below.

According to an embodiment the container drying device further comprises a top element defining a top of the at least two booths, the axis of rotation being rotatably attached to the top element.

Providing a bottom element and/or a top element provides for a container drying device being particularly robust and stable in structure.

According to an embodiment the container drying device further comprises two opposite inner side elements, the two inner side elements being arranged adjacent the axis of rotation such as to define a fixed inner side of each of the at least two booths.

Thereby a container drying device is provided which has particularly well defined booths, and in which it is ensured that the stacks of containers cannot come to interfere with the axis of rotation during rotation of the device.

According to an embodiment the closing device comprises at least two closing elements, each of the two booths being associated with at least one closing element.

Thereby it is ensured that all stacks of containers arranged in the device are held in place during rotation independently of one another and in a particularly safe manner.

According to an embodiment the container drying device further comprises at least one track adapted for guiding a stack of containers into one of the at least two booths.

With such a track, a container drying device is provided in which it is ensured that the stacks of containers are always arranged with the same predetermined orientation in the device, thus ensuring that the stacks of containers are held in a particularly simple and safe manner during rotation.

According to an embodiment the fixed outer side of each of the at least two booths extends substantially in parallel with the loading direction.

Thereby a container drying device is provided which has a particularly simple construction, and in which loading and unloading of the stacks is made simple in that it is ensured that the stacks of containers are always arranged with the same predetermined orientation in the device.

According to an embodiment the least one closing device is adapted for closing at least a part of a side of the container drying device extending between the two fixed outer sides when placed in the closed position.

Thereby a container drying device having a closing system comprising closing devices of a particularly simple construction is provided.

According to an embodiment the container drying device further comprises a blocking device being movable between a closed position in which the blocking device exerts a retaining force in a direction being substantially perpendicular to the loading direction, and preferably furthermore being perpendicular to the axis of rotation, for further retaining the at least one stack of containers within each of the at least two booths during rotation of the container drying device and an open position in which the at least one stack of containers may be loaded into and/or removed from each of the at least two booths.

Thereby a container drying device is provided in which the stacks of containers may be retained in a particularly robust manner during rotation, which in turn provides for a particularly robust and sturdy container drying device capable of withstanding very high centrifugal forces during rotation.

Furthermore, the invention also concerns a container drying apparatus comprising a container drying device according to the invention and a housing.

SHORT DESCRIPTION OF THE DRAWINGS

Figure 2:
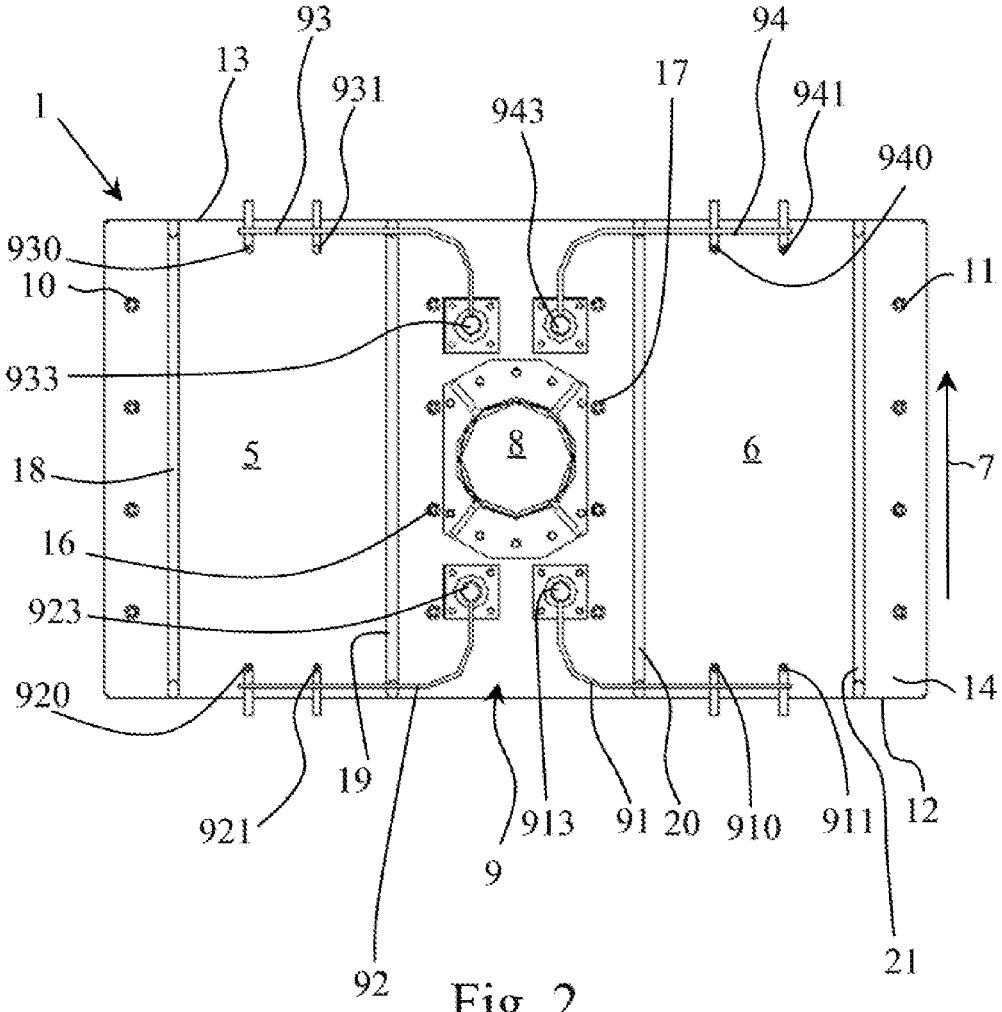
Figure 3:
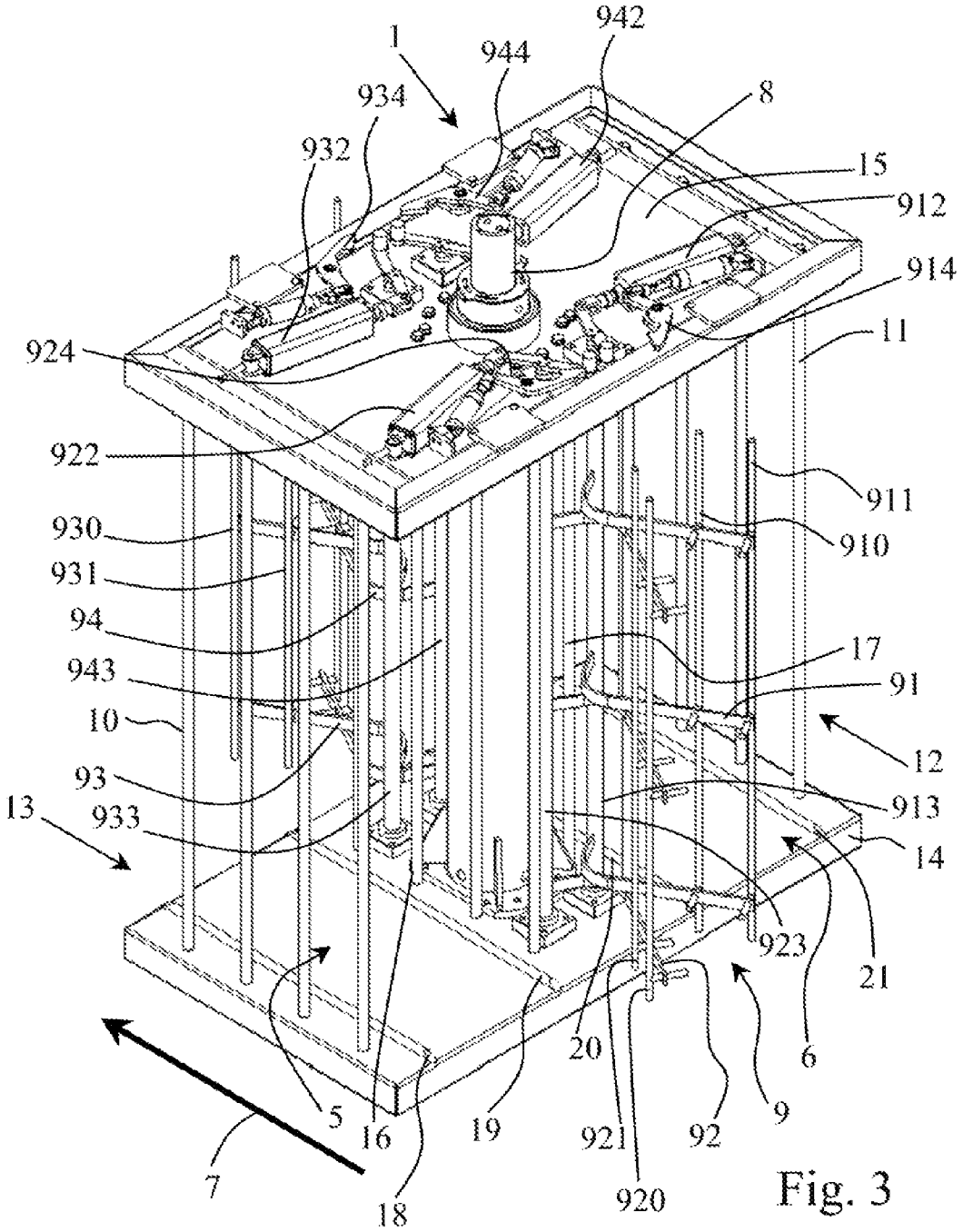
Figure 4:
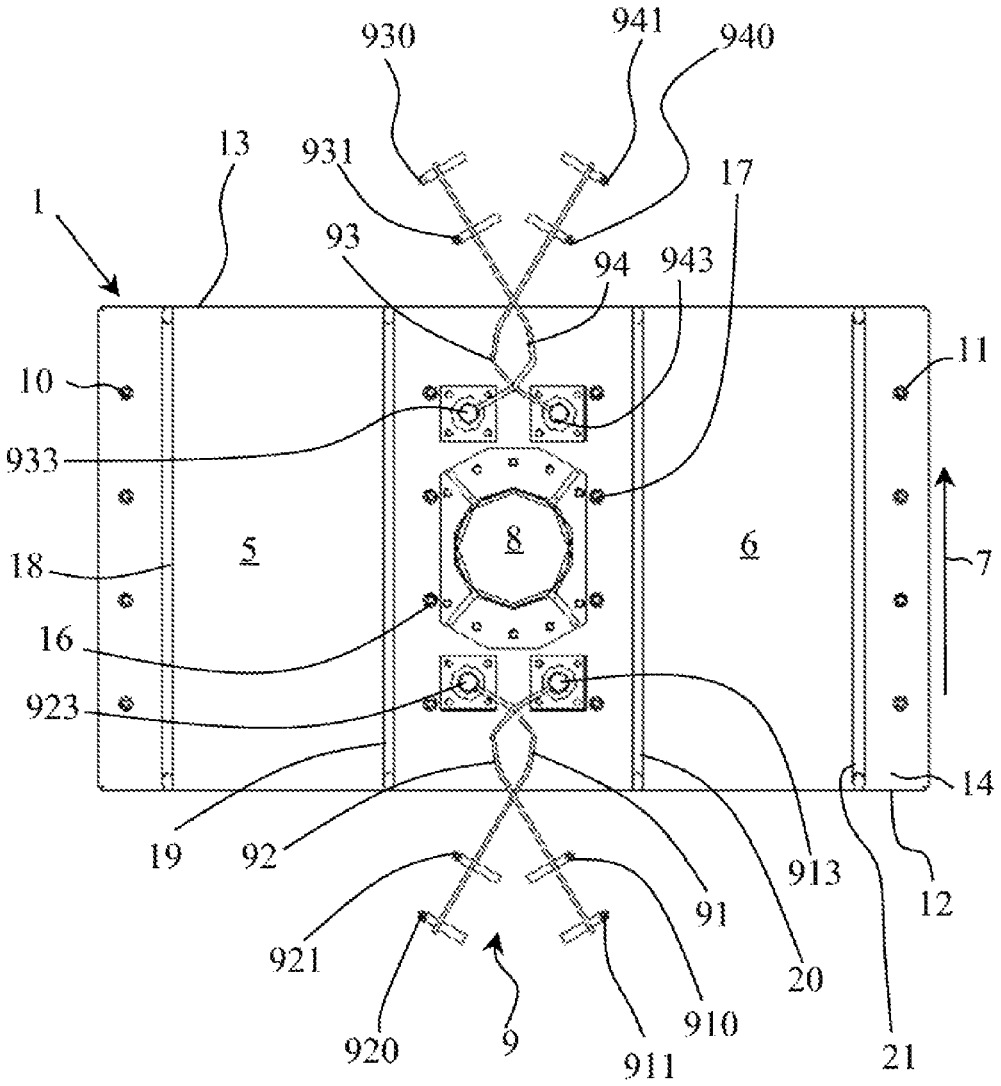
Figure 5:
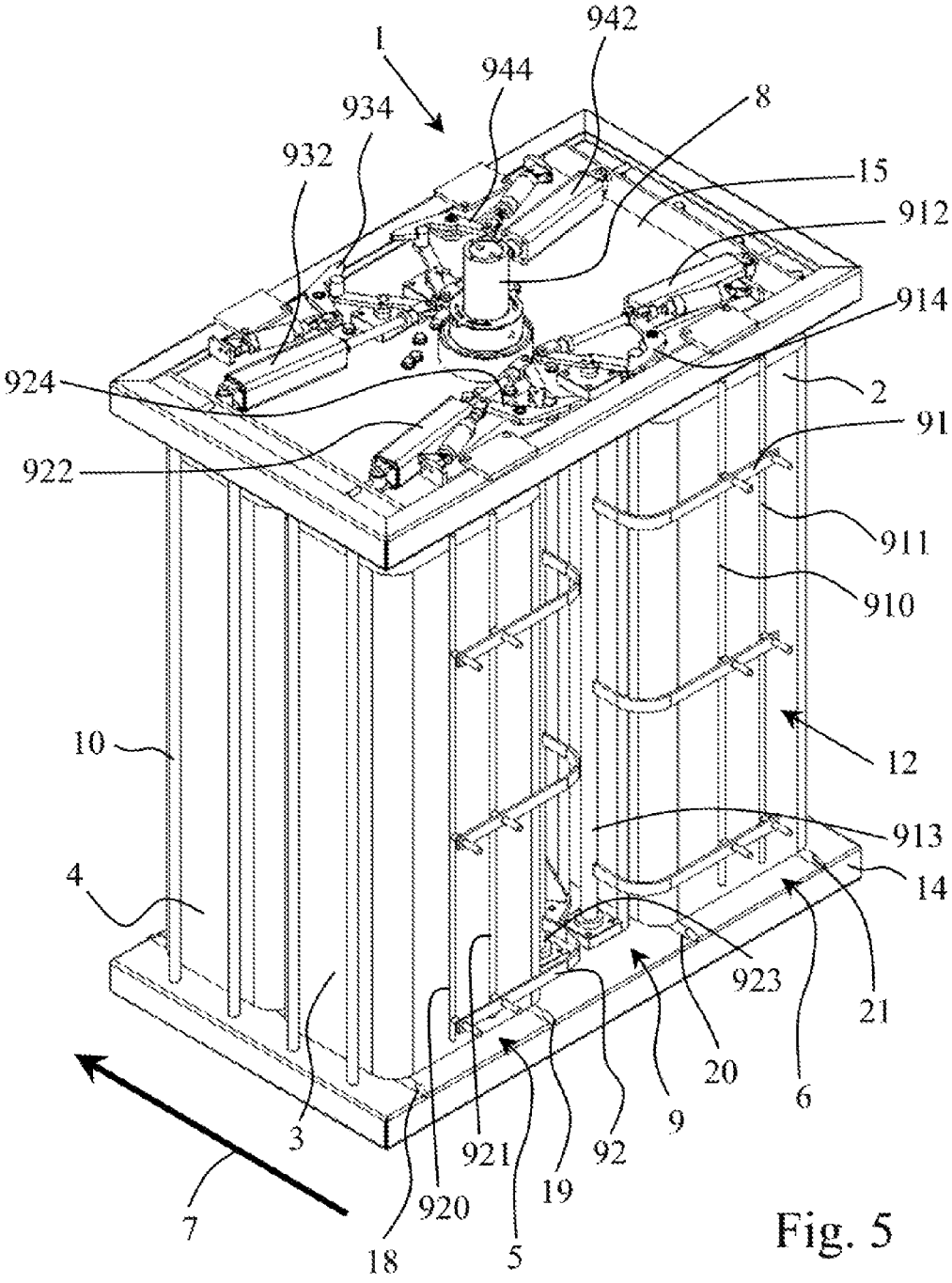
Figure 6:
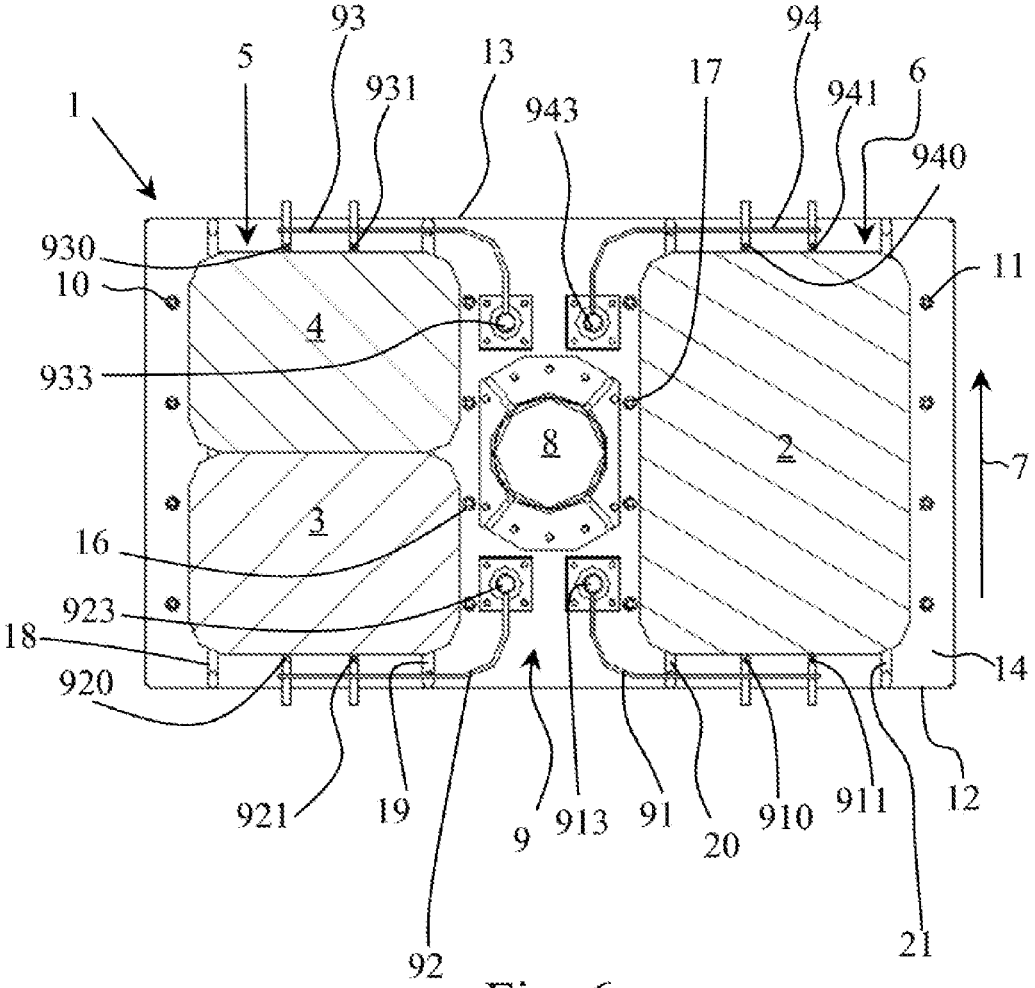
Figure 7:
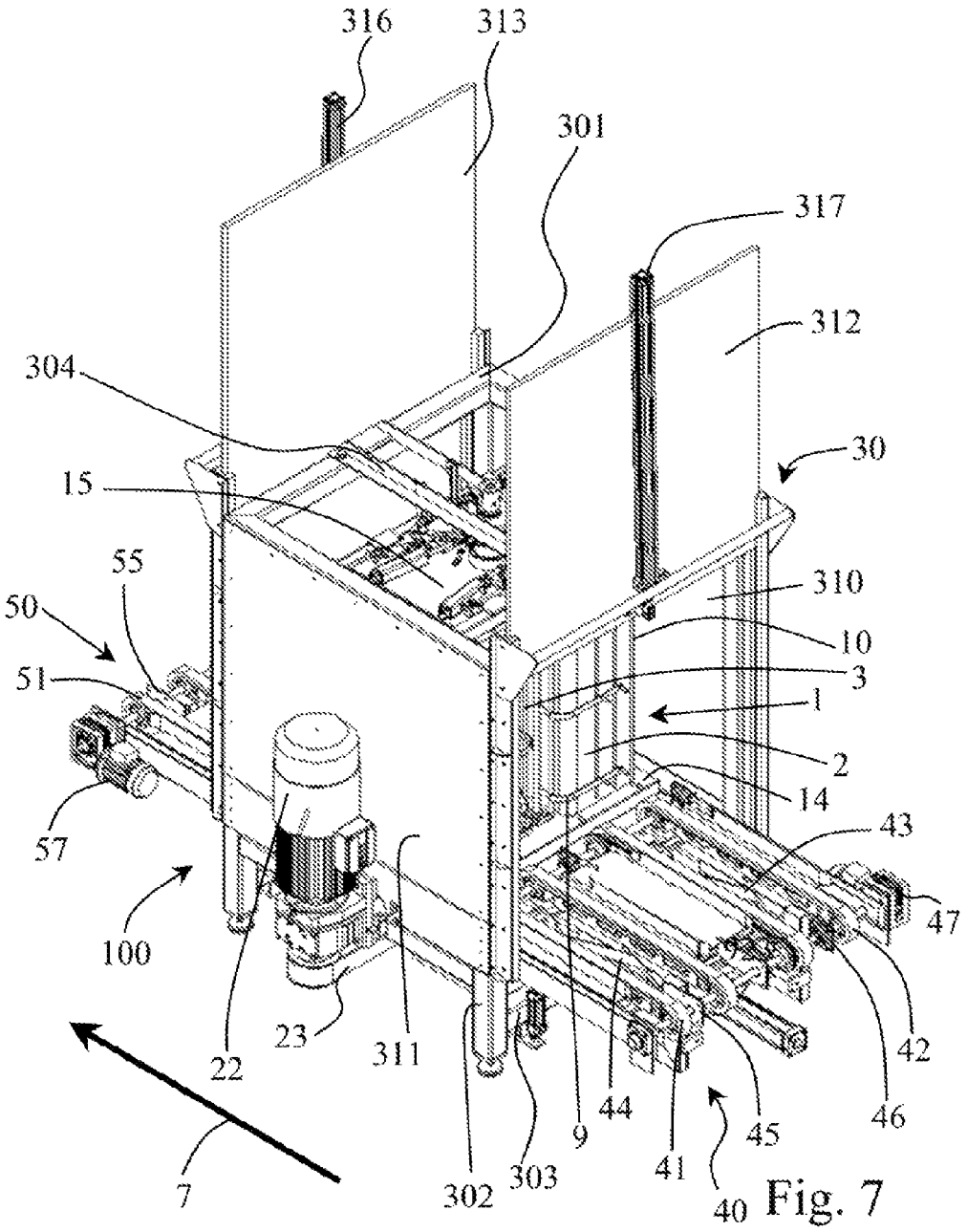
Figure 8:
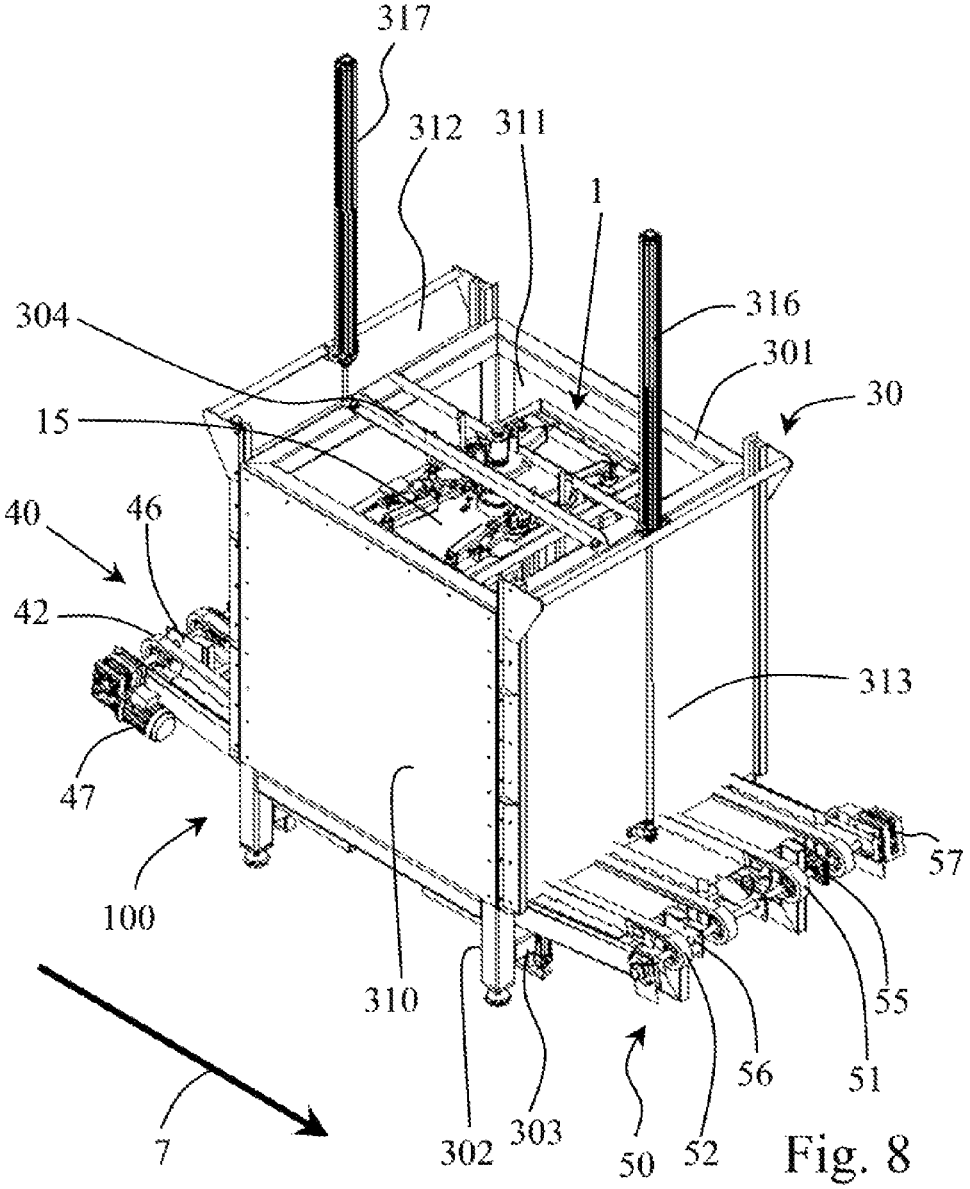
Figure 9:
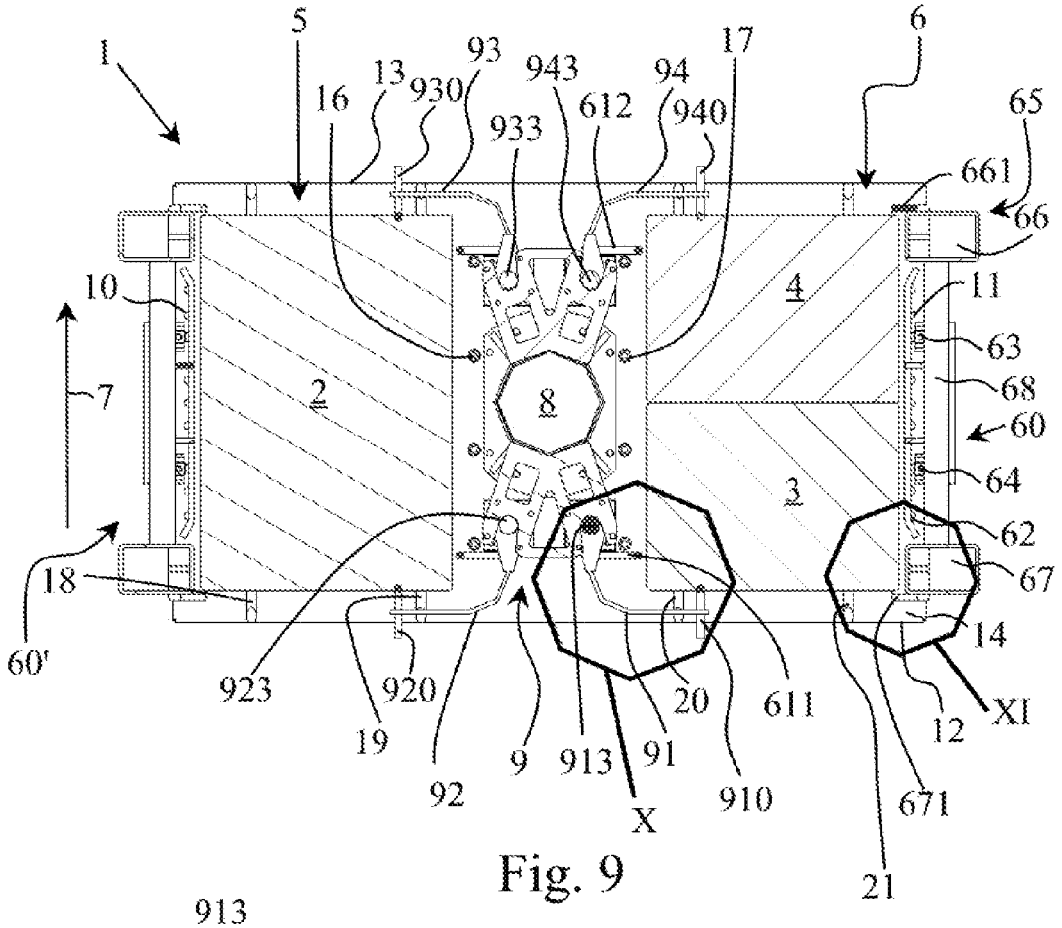
Figure 10:
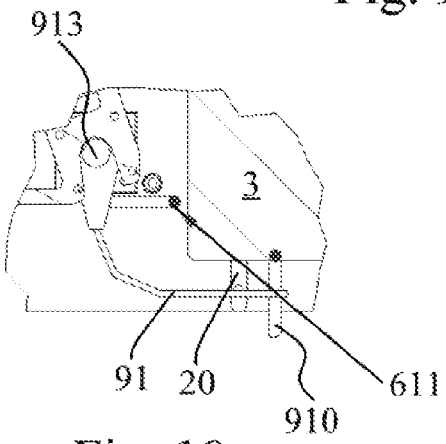
Figure 11:
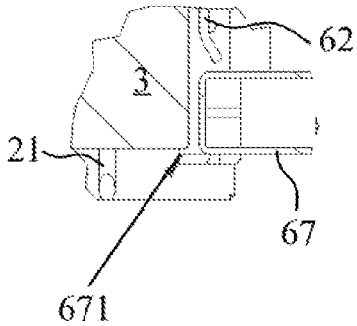
Figure 12:
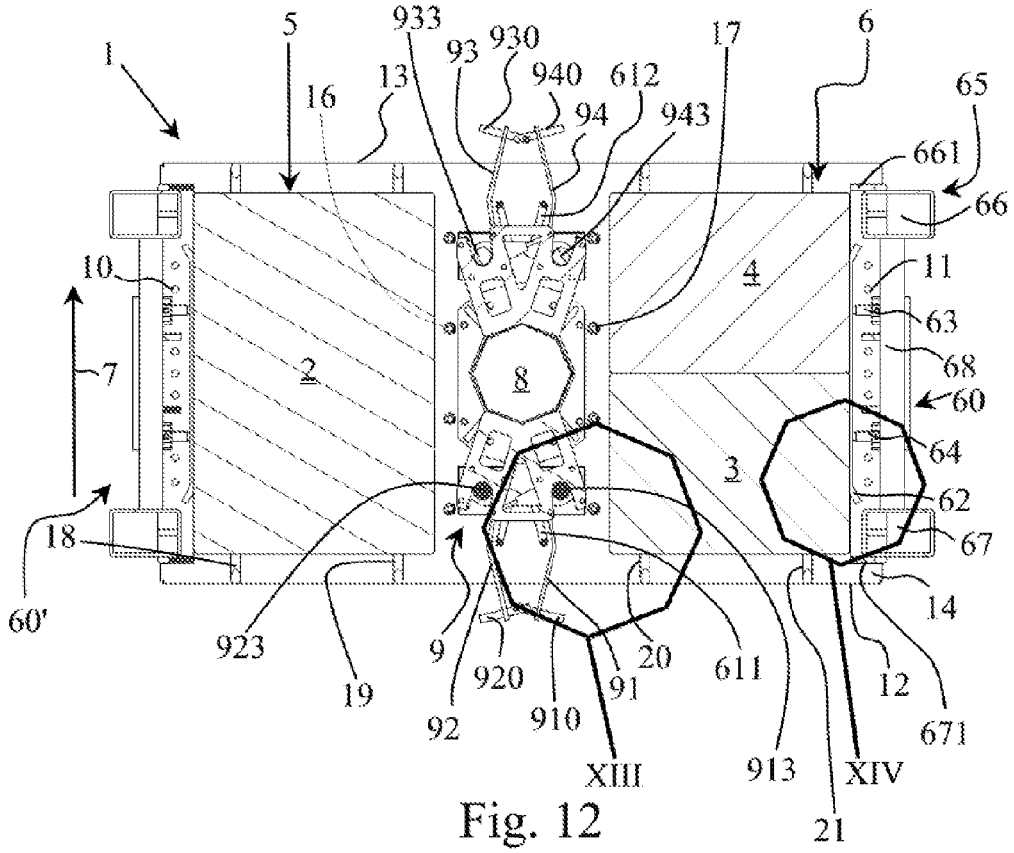
Figure 13:
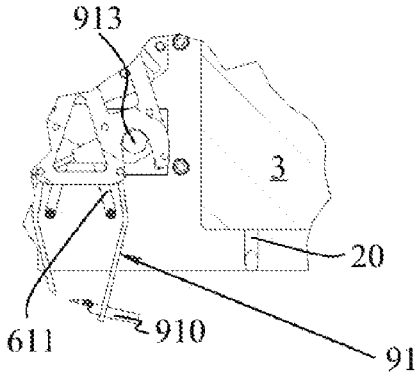
Figure 14:
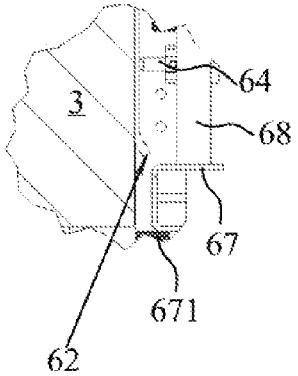

The invention will be described in more detail below by means of a non-limiting example of an embodiment and with reference to the schematic drawings, in which FIG. 1 shows a perspective view of an embodiment of a container drying device according to the invention with a closing device in a closed position, FIG. 2 shows a cross sectional view seen from above of the container drying device according to FIG. 1, FIG. 3 shows a perspective view of the container drying device according to FIG. 1 with the closing device in an open position, FIG. 4 shows a cross sectional view seen from above of the container drying device according to FIG. 3, FIG. 5 shows a perspective view of the container drying device according to FIG. 1 with the closing device in the closed position and with stacks of containers loaded in the two booths of the container drying device, FIG. 6 shows a cross sectional view seen from above of the container drying device according to FIG. 5, FIG. 7 shows a perspective view of an embodiment of a container drying apparatus according to the invention comprising a container drying device and a housing with slidable sides in an open position allowing for the loading and unloading of containers, FIG. 8 shows a perspective view of a container drying apparatus according to FIG. 7 seen from a different angle of view and with the slidable sides of the housing in a closed position, FIG. 9 shows a cross sectional view seen from above of an embodiment of a container drying device according to the invention comprising a blocking device shown in a closed position and with a closing device in a closed position, FIGS. 10 and 11 show enlarged views of details corresponding to the sections X and XI, respectively, of FIG. 9, FIG. 12 shows a cross sectional view seen from above of the container drying device according to FIG. 9 with the blocking device and the closing device in an open position, and FIGS. 13 and 14 show enlarged views of details corresponding to the sections XIII and XIV, respectively, of FIG. 12.

DETAILED DESCRIPTION OF THE INVENTION

FIGS. 1 to 4 show an embodiment of a container drying device 1 according to the invention. The container drying device 1 comprises two booths 5, 6, an axis of rotation 8 about which the container drying device is rotatable and a closing device 9.

With reference also to FIGS. 5 and 6, each booth 5, 6 is adapted to receive at least one stack of containers 2, 3, 4 in a use position of the container drying device 1. The stacks of containers 2, 3, 4 to be dried are loaded into the at least two booths in a loading direction 7 through a first side 12 of the container drying device 1. Similarly, upon completion of a drying cycle the now dry stacks of containers are unloaded from the at least two booths 5, 6 in the loading direction 7 through a second side 13 of the container drying device 1 opposite the first side 12. In an alternative embodiment, it is feasible that loading and unloading of the stacks of containers may take place from the same side 12 or 13 of the container drying device, while the opposite side 13 or 12 is an at least partially closed side.

The booths 5 and 6 are rectangular and are adapted for receiving stacks of containers in which each container has a particular cross sectional size. The booths may in alternative embodiments be adapted for accomodating stacks of containers of which each container has a different cross sectional size or sizes and/or other cross sectional shapes than rectangular.

As shown in FIGS. 5 and 6, booth 6 accommodates one stack of containers 4 substantially taking up the whole cross sectional area of the booth, while booth 5 accommodates two stacks of containers 2, 3 each having half the cross sectional size of the stack of containers 4 and each therefore substantially taking up half of the cross sectional area of the booth. Hence, it is also possible for a booth of a container drying device according to the invention to accommodate several stacks of containers which between them take up the whole cross sectional area of a booth.

Generally, the at least two booths 5, 6 are arranged excentrically in the container drying device 1, symmetrically on opposite sides of the axis of rotation 8 in the container drying device 1 and in parallel with each other in the container drying device 1. Particularly, the at least two booths 5, 6 are arranged in parallel with respect to each other as seen in a direction perpendicular to the loading direction 7 in the container drying device 1.

Expressed in more detail, the booths 5, 6 shown on the Figures are rectangular in cross section, each with first opposite sides and second opposite sides, the first opposite sides being longer than the second opposite sides, and the booths 5, 6 are arranged in the container drying device 1 in such a way that the first opposite sides of each booth 5, 6 extend substantially in parallel with respect to each other and parallel to the loading direction 7, and such that each of the second opposite sides of each booth 5, 6 extend substantially in extension of each other.

The booths, however, are not limited to being rectangular in cross section, but may have any other shape such as e.g. quadratic, polygonal, elliptic or even circular.

To perform centrifugal drying of the stacks of containers 2, 3, 4 the container drying device 1 is rotatable around the axis of rotation 8, which extends in a direction substantially perpendicular to the loading direction 7, and which is arranged centrally in the container drying device 1. To this end the container drying device 1 comprises a drive unit 22, cf. FIG. 7. Such a drive unit 22 may in principle be any drive unit suitable for rotating the container drying device with a sufficiently high number of revolutions per time unit. Preferably, the drive unit 22 is an electric motor connected to the axis of rotation 8 by means of a transmission element 23, such as a drive belt or a cardan drive.

The closing device 9 is in FIGS. 1 and 2 shown in a closed position, while FIGS. 3 and 4 show the closing device in an open position. The closing device 9 comprises in the embodiment shown four closing elements 91, 92, 93, 94 such that each booth 5, 6 is associated with two closing elements. Particularly, booth 5 is associated with closing elements 92 and 93 while booth 6 is associated with closing elements 91 and 94.

It is noted that another number of closing elements than two for each booth is also feasible. For instance each side 12 and 13 of the container drying device 1 may be associated with one closing element adapted to close off the whole side. Alternatively, each booth may be associated with one closing element adapted to close off both sides 12 and 13 of the booth simultaneously.

Each closing element 91, 92, 93, 94 comprises one or more abutment elements 910, 911, 920, 921, 930, 931, 940, 941, in the embodiment shown two rods or bars, adapted for abutment against a stack of crates 2, 3, 4 in the closed position of the closing device 9.

Each closing element 91, 92, 93, 94 further comprises an actuator 912, 922, 932, 942 for moving the closing element 91, 92, 93, 94 between the closed position and the open position. FIG. 1 shows the actuators 912, 922, 932, 942 in a position corresponding to the closed position of the closing device 9, while FIG. 3 shows the actuators 912, 922, 932, 942 in a position corresponding to the open position of the closing device 9.

Each closing element 91, 92, 93, 94 further comprises a rotatable rod or bar 913, 923, 933, 943 actuated by means of the actuator 912, 922, 932, 942 for rotation around and axis of rotation extending substantially perpendicular to the loading direction 7, thus moving the closing element 91, 92, 93, 94 between the closed position (FIG. 1) and the open position (FIG. 3).

In the embodiment shown the actuators 912, 922, 932, 942 are pneumatic actuators, but may just as well be e.g. hydraulic actuators, electric actuators or actuators driven by means of a motor. As may be seen on FIGS. 1 and 3, the atuators 912, 922, 932, 942 are furthermore of the type comprising a piston and a piston rod, the piston motion actuating a transmission element in the form of an arm connected to the rotatable bar 913, 923, 933, 943 and transferring the piston motion into a rotation of the rotatable bar.

As may furthermore be seen on FIGS. 1, 3 and 5, each closing element 91, 92, 93, 94 further comprises a locking element 914, 924, 934, 944 arranged next to and cooperating with the respective actuators 912, 922, 932, 942 such as to lock each closing element 91, 92, 93, 94 in its closed position.

The locking elements 914, 924, 934, 944 are preferably triggered to lock by means of a separate spring associated with the locking element such as to be independent of the actuators. However, the locking elements are nevertheless preferably released by means of the respective actuators 912, 922, 932, 924.

It is noted that the embodiment of the closing device 9 shown on the figures is only a non-limiting example, and that many other embodiments of a closing device are feasible as long as the closing device is movable between a closed position in which the closing device closes each of the booths at least partially such as to retain the stacks of containers within the booths during rotation of the container drying device and an open position in which the stacks of containers may be loaded into and/or removed from each of the booths. In an alternative, the closing device may e.g. be of an embodiment in which the one or more abutment elements are connected hinged to bars corresponding to the rotatable bars as described above. In this case such bars need not be rotatable themselves.

In the embodiment shown in the figures, the container drying device 1 furthermore comprises opposite outer side elements 10 and 11. The outer side elements 10 and 11 define a fixed outer side of each of the two booths 5, 6. The outer side elements 10, 11, and thereby the fixed outer sides, are arranged opposite said axis of rotation 8 such that the fixed outer sides extend in parallel with the loading direction 7.

As shown in the figures, the outer side elements 10 and 11 are rods or bars, such that the fixed outer sides are each provided as four interspaced, preferably regularly interspaced, rods or bars. In alternative embodiments the provision of another number of rods or bars are feasible. Also, the side elements may be provided e.g. as one or more plate shaped elements.

In the embodiment shown in the figures, the container drying device 1 furthermore comprises opposite inner side elements 16 and 17. The inner side elements 16 and 17 define a fixed inner side of each of the two booths 5, 6. The inner side elements 16, 17, and thereby the fixed inner sides, are arranged adjacent said axis of rotation 8 such that the fixed inner sides extend in parallel with the loading direction 7.

As shown in the figures, the inner side elements 16 and 17 are rods or bars, such that the fixed outer sides are each provided as four interspaced, preferably regularly interspaced, rods or bars. In alternative embodiments the provision of another number of rods or bars are feasible. Also, the side elements may be provided e.g. as one or more plate shaped elements.

Furthermore, the container drying device 1 comprises a bottom element 14 and a top element 15 defining a bottom and a top, respectively, of the booths 5, 6. The axis of rotation 8 is rotatably attached to both the bottom element 14 and the top element 15.

Likewise the rotatable rods 913, 923, 933, 943 of the closing device 9 are rotatably attached to both the bottom element 14 and the top element 15. Also, and as shown in FIGS. 1 and 3, the actuators 912, 922, 932, 942 are arranged on the top element 15 opposite the booths 5, 6 and are connected to the rotatable rods 913, 923, 933, 943 which to that end extend through the top element 15. Thereby the top element 15 protects the actuators 912, 922, 932, 942 from the water dried off of the stacks of containers by the centrifugal force during rotation of the container drying device 1.

The fixed outer side elements 10, 11 and the closing device 9, as well as the fixed inner side elements 16, 17, the bottom element 14 and the top element 15 where present, are preferably made of a rigid and durable material, particularly a material which is resistant to water and cleaning agents, such as a metal, possibly comprising a suitable finishing, such as a coating or a film. Preferred metals include steel, stainless steel and aluminium.

Furthermore, each booth 5, 6 comprises a set of tracks 18, 19 and 20, 21, respectively, adapted for guiding the stacks of containers into the proper position in the booth. As shown, the sets of tracks 18, 19, 20 21 are provided as grooves in the bottom element 14.

Alternatively the tracks may be provided as protruisons on the bottom element 14 and/or another number of tracks than two, e.g. one or three, may be present. Also it is feasible that the tracks be provided in or on any of the fixed sides or the top element. In another alternative embodiment the tracks may simply be adapted for marking the designated area in which the stacks of containers are to be placed in the booths without having a guiding effect as such.

Turning now towards FIGS. 9 to 14 a container drying device 1 according to another embodiment of the invention is shown. The container drying device 1 according to FIGS. 9 to 14 comprises the same elements and features as the above described container drying device, albeit with one exception which will be described in the following.

The container drying device 1 according to FIGS. 9 to 14 comprises a blocking device 60 associated with the booth 6 and a blocking device 60' associated with the booth 5. Put in general terms, the blocking device 60 and 60' are movable between a closed position shown in FIG. 9 and an open position shown in FIG. 12.

In the closed position the blocking devices 60, 60' exert a retaining force on at least one stack of containers 2, 3, 4 placed in the adjacent booth 5, 6. The retaining force is exerted by the blocking devices 60, 60' in a direction being substantially perpendicular to the loading direction 7, and preferably furthermore being perpendicular to the axis of rotation 8. Described in other words, the retaining force is exerted by the blocking devices 60, 60' in a direction extending between and perpendicular to the inner and outer side elements, e.g. the inner and outer side element 11 and 17 in FIGS. 9 and 12. In the open position of the blocking devices 60, 60' the at least one stack of containers 2, 3, 4 may be loaded into and/or removed from each of the at least two booths 5, 6.

In the following only the blocking device 60 associated with the booth 6 is described in detail. It is noted, however, the blocking device 60' associated with the booth 5 comprises the same elements the blocking device 60 associated with the booth 6.

In the specific but non-limiting embodiment shown in FIGS. 9 to 14 the blocking device 60 comprises, with reference to the parts associated with the booth 6, two pushing elements 611, 612 mounted in connection with the closing device 9 and a stop device 65 mounted in connection with the fixed outer side element 11.

The two pushing elements 611, 612 are mounted such as to be movable with the closing device 9 between the closed and the open position, but may in principle alternatively be mounted such as to be separately movable between the closed and the open position. The two pushing elements 611, 612 may be rod-shaped as shown or may alternatively have any other suitable shape such as plate shaped. Alternatively, only one or more than two pushing elements may be provided.

The stop device 65 comprises in the embodiments shown two stop elements 66, 67, an intermediate element 68 arranged between the stop elements 66, 67 and two actuators 63, 64 mounted on the intermediate element for moving the stop device between the closed and the open position. The stop device further comprises a rail 62 arranged such as to be movable by means of the two actuators 63, 64.

The two stop elements 66, 67 are in the embodiment shown bars extending between the bottom element 14 and the top element 15 of the container drying device 1. Alternatively, only one or more than two stop elements may be provided. In other alternatives the one or more stop elements may be provided with a different cross sectional shape than the rectangular one shown on the figures, or may be provided as e.g. plates rather than bars. In another alternative the stop elements may extend only partially between the bottom element 14 and the top element 15 and/or be attached to the fixed outer side elements 11.

Furthermore the two stop elements 66, 67 may optionally and as shown in FIGS. 9, 11, 12 and 14 comprise a protrusion 661, 671, respectively, for in the closed position extending in a direction perpendicular to the loading direction 7, and thus in parallel with the sides 12, 13. The protrusions 661, 671 extend in the closed position of the blocking device 60 around the corners of the stacks of containers 3, 4 and thereby provide for an improved retention of the stacks of containers 3, 4 in a direction parallel to the loading direction 7.

The intermediate element 68 is likewise provided as a bar extending substantially in the loading direction 7. Alternatively, more than one intermediate element, e.g. two, three or four intermediate elements, may be provided. In other alternatives the one or more intermediate elements may be provided with a different cross sectional shape than the rectangular one shown on the figures, or may be provided as e.g. plates rather than bars.

The rail 62 may be provided at one or more bars or alternatively as a plate.

The actuators 63, 64 may be pneumatic actuators, but may just as well be e.g. hydraulic actuators, electric actuators or actuators driven by means of a motor. The actuators 63, 64 are shown as cylindrical pistons, but may just as well be any other feasible and suitable type of actuator.

The blocking device 60 works as follows. When the blocking device 60 is moved into the closed position (FIG. 9), the pushing elements 611, 612 push the stacks of containers 3, 4 loaded into the booth 6 towards and into contact with the stop elements 66, 67 and, possibly, the rail 62 (FIGS. 10 and 11). Thereby the stacks of containers 3, 4 are securely retained between the pushing elements 611, 612 and the stop device. When the blocking device 60 is moved into the open position (FIG. 12), the pushing elements 611, 612 are moved to the side (FIG. 13). Also, the actuators 63, 64 are actuated to cause the rail 62 to push the stacks of containers 3, 4 towards the inner side element 17 and thus away from the stop elements 66, 67 (FIG. 14). Thereby the stacks of containers 3, 4 may easily be removed from the booth 6 of the container drying device.

Turning now towards FIGS. 7 and 8 a container drying apparatus 100 according to the invention and comprising a container drying device according to the invention and a framing, casing or housing 30 is shown. Preferably, the container drying device is a container drying device 1 according to the above described embodiment.

The housing 30 comprises a frame structure 301 with legs 302, a bottom structure 303 and a top structure 304. The container drying device 1, and particularly the axis of rotation 8 of the container drying device, is suspended from the frame structure 301, particularly by being connected to the top structure 304 and/or the bottom structure 303.

The housing 30 further comprises two fixed side plates 310, 311 arranged on the outside of the two fixed sides of the container drying device 1 defined by the side elements 10, 11 and two movable side plates 312, 313 arranged on the outside of the two sides 12, 13 of the container drying device 1 extending between the two fixed sides.

The two movable side plates 312, 313 are movable between a closed position (FIG. 7) in which the two sides 12, 13 of the container drying device 1 are closed off and an open position (FIG. 8) in which the two sides 12, 13 of the container drying device 1 are uncovered. In the embodiment shown this is achieved by mounting the two movable side plates 312, 313 on respective lifting devices in the form of pistons 316, 317 connected to the frame structure 301. Alternatively the two movable side plates 312, 313 may be suspended in slide bars 316, 317 arranged in guides In a not shown embodiment the housing 30 may furthermore comprise fixed or movable bottom and/or top plates.

The container drying apparatus 100 shown in FIGS. 7 and 8 further comprises a first transporter 40 adapted for loading stacks of containers 2, 3, 4 into the container drying device 1 and a second transporter 50 adapted for unloading stacks of containers 2, 3, 4 from the container drying device 1.

The first transporter 40, which is best seen in FIG. 7, comprises two parallel extending separate conveyors 41, 42 for transporting at least two stacks of containers 2, 3, 4 from a container washing apparatus (not shown) to and into the container drying device 1 simultaneously. Each of the conveyors 41, 42 comprises a raising and lowering mechanism 45, 46, respectively, and a pushing element 43, 44, respectively.

The pushing elements 43, 44 are adapted to push the stacks of containers 2, 3, 4 the last bit of way into the container drying device 1 such as to ensure correct positioning of the stacks of containers 2, 3, 4 in the container drying device 1.

The raising and lowering mechanisms 45, 46 are used to lower the conveyors 41, 42 after loading the stacks of containers 2, 3, 4 into the container drying device 1 and before lowering the movable side plate 317 (cf. the position shown in FIG. 8) as well as to raise the conveyors 41, 42 after drying the stacks of containers 2, 3, 4 and raising the movable side plate 317 and before unloading the stacks of containers 2, 3, 4 (cf. the position shown in FIG. 7). Thereby it is ensured that the container drying device 1 is properly closed off during the drying cycle.

The raising and lowering mechanisms 45, 46 may be actuated by a rotational movement about an axle or alternatively as a parallel, preferably vertical, lifting movement.

The conveyors 41, 42 are driven by means of a common drive mechanism 47, which in the embodiment shown is an electric motor connected to a driving rod. Alternatively each conveyor 41, 42 may be assigned its own drive mechanism.

The second transporter 50, which is best seen in FIG. 8, is similar to the first transporter 40, and thus comprises two parallel extending separate conveyors 51, 52 for transporting at least two stacks of containers 2, 3, 4 out of and away from the container drying device 1 simultaneously. Each of the conveyors 51, 52 comprises a raising and lowering mechanism 55, 56, respectively, and a pushing element 53, 54, respectively.

The pushing elements 53, 54 are adapted to push the stacks of containers 2, 3, 4 the last bit of way into the container drying device 1 such as to ensure correct positioning of the stacks of containers 2, 3, 4 in the container drying device 1.

The raising and lowering mechanisms 55, 56 are used to lower the conveyors 51, 52 after loading the stacks of containers 2, 3, 4 into the container drying device 1 and before lowering the movable side plate 316 (cf. the position shown in FIG. 8) as well as to raise the conveyors 51, 52 after drying the stacks of containers 2, 3, 4 and raising the movable side plate 316 and before unloading the stacks of containers 2, 3, 4 (cf. the position shown in FIG. 7). Thereby it is ensured that the container drying device 1 is properly closed off during the drying cycle.

The conveyors 51, 52 are driven by means of a common drive mechanism 57, which in the embodiment shown is an electric motor connected to a driving rod. Alternatively each conveyor 51, 52 may be assigned its own drive mechanism.

The container drying device 1 may furthermore comprise means (not shown), such as an outlet or a channel or a piping, for collecting and/or draining off the water removed from the stack of containers by means of the centrifugal force.

A container drying device according to the invention works as follows:

At least two stacks of containers, which have been washed and are therefore wet, are, preferably simultaneously, fed into the booths of the container drying device manually or by means of a feeder such as the transporter 40 described above.

Correct placement of the stacks of containers in the booths is ensured, e.g. by means of pushing elements as described above.

The closing device 9 is brought from an open position to the closed position such as to retain the stacks of containers in the container drying device and such as to retain the stacks of containers within each of the two booths during rotation.

The container drying device 1 is then brought to rotate around the rotation axis 8 such as to dry the stacks of containers by means of the centrifugal force, which due to the position of the containers is directed towards the fixed outer sides of each booth.

When the container drying device has been rotating for a predetermined period of time sufficient to dry the stacks of containers thoroughly it is brought to stop.

The closing device 9 is then brought from the closed position to the open position such as to allow, preferably simultaneous, unloading of the stacks of containers from the container drying device.

Finally the stacks of containers 2, 3, 4 are removed or unloaded, preferably simultaneously, from the container drying device manually or by means of a feeder such as the transporter 50 described above.

The stacks of containers may then be transported to another place or treatment by means of a transporter such as the transporter 50.

Hence, a container drying device 1 and a container drying apparatus 100 according to the invention is intended for use in a running or continuous production cycle of e.g. foodstuffs or pharmaceutical or medical products. Thus, the container drying device 1 and container drying apparatus 100 according to the invention may be adapted for treating any size and type of containers of the type intended covered by the term "container" as used herein.

The invention should not be regarded as being limited to the described embodiments. Several modifications and combinations of the different embodiments will be apparent to the person skilled in the art. For instance, one or more of the features and elements described above, particularly the fixed outer side elements 10, 11, the inner side elements 16, 17, the closing device 9 and/or the blocking devices 60, 60', may be reinforced, e.g. by means of suitable reinforcing elements attached to or embedded in the elements, or by making parts of the feature or element thicker and/or harder than other parts.

The invention claimed is:

1. Container drying device of the spin-dryer type for drying stacks of containers comprising:

at least two booths, each booth being adapted to accommodate at least one stack of containers in a use position of said container drying device, said at least one stack of containers being loaded into said at least two booths in a loading direction, an axis of rotation about which the container drying device is rotatable, said axis of rotation extending in a direction perpendicular to the loading direction, and said axis of rotation being arranged centrally in said container drying device, and wherein said container drying device further comprises a closing device being movable between a closed position in which the closing device closes said at least two booths at least partially to retain said at least one stack of containers within each of said at least two booths during rotation of said container drying device and an open position in which said at least one stack of containers may be loaded into and/or removed from each of said at least two booths, said at least two booths being arranged eccentrically, symmetrically on opposite sides of said axis of rotation and in parallel with each other in said container drying device, and wherein the container drying device further comprises two opposite sides extending perpendicular to said loading direction, one of said two opposite sides being an entry side through which said at least two stacks of containers may be loaded into the container drying device simultaneously, and the other of said two opposite sides being an exit side through which said at least two stacks of containers may be removed from said container drying device simultaneously.

2. The container drying device according to claim 1, and further comprising at least two opposite outer side elements, said at least two outer side elements being arranged to define a fixed outer side of each of said at least two booths opposite said axis of rotation, said at least two booths being arranged eccentrically, symmetrically on opposite sides of said axis of rotation and in parallel with each other in the container drying device such that during rotation of the container drying device the centrifugal forces acting on said at least one stack of containers arranged in said at least two booths are directed towards said at least two outer side elements.

3. The container drying device according to claim 2, wherein said fixed outer side of each of said at least two booths extends in parallel with said loading direction.

4. The container drying device according to claim 1, and further comprising a bottom element defining a bottom of said at least two booths, said axis of rotation being rotatably attached to said bottom element.

5. The container drying device according to claim 1, and further comprising a top element defining a top of said at least two booths, said axis of rotation being rotatably attached to said top element.

6. The container drying device according to claim 1, and further comprising two opposite inner side elements, said two inner side elements being arranged adjacent said axis of rotation to define a fixed inner side of each of said at least two booths.

7. The container drying device according to claim 1, wherein said closing device comprises at least two closing elements, each of the two booths being associated with at least one said closing element.

8. The container drying device according to claim 1, and further comprising at least one track adapted for guiding a stack of containers into one of said at least two booths.

9. The container drying device according to claim 1, and further comprising a blocking device being movable between a closed position in which said blocking device exerts a retaining force in a direction being perpendicular to said loading direction for further retaining said at least one stack of containers within each of said at least two booths during rotation of said container drying device and an open position in which said at least one stack of containers may be loaded into and/or removed from each of said at least two booths.

10. The container drying device according to claim 9, wherein said blocking device where in said closed position exerts the retaining force in the direction being perpendicular to said loading direction and the retaining force furthermore being exerted perpendicular to said axis of rotation.

11. Container drying apparatus comprising:

a container drying device according to claim 1; and a housing.

12. The container drying device according to claim 1, wherein the stacks of containers are stacks of containers for distributing foodstuffs.

* * * * *